United States Patent [19]

Cimillo

[11] Patent Number: 4,965,115

[45] Date of Patent: Oct. 23, 1990

[54] MULTI-PURPOSE FLEXIBLE DEVICES, METHOD OF MAKING SAME AND ARTICLES MADE THEREFROM

[76] Inventor: Paul J. Cimillo, 180 Walnut St., Apt. A51, Montclair, N.J. 07042

[21] Appl. No.: 293,301

[22] Filed: Jan. 4, 1989

[51] Int. Cl.[5] ..... B65D 77/10

[52] U.S. Cl. ..... 428/131; 24/30.5 P; 428/52; 428/53; 428/132; 428/903.3

[58] Field of Search ..... 428/52, 53, 131, 132, 428/903.3; 24/30.5 P

[56] References Cited

U.S. PATENT DOCUMENTS

| | | | |
|---|---|---|---|
| 3,779,448 | 12/1973 | Wooften | 428/133 |
| 3,973,610 | 8/1976 | Ballin | 24/30.5 P |
| 4,287,693 | 9/1981 | Collette | 428/53 |

*Primary Examiner*—Ellis P. Robinson
*Assistant Examiner*—Archene A. Turner
*Attorney, Agent, or Firm*—Charles E. Baxley

[57] ABSTRACT

A flexible device is an elongated member of desired form and is makable by separating the tread from the remainder of a used rubber tire and cutting the tread to the desired form. The device has a hole of predetermined dimensions therethrough and a barbed portion spaced from the hole and adapted for one-way entry in either direction through a hole of the predetermined dimensions and into interlocking engagement therewith. The device preferably has two (2) identical barbed portions, and (1) at each end, and symmetrical with respect to a longitudinal centerline, and there is a plurality of the holes through the device. The holes are circular and at least some of them are on the centerline. An article can be fabricated from a plurality of flexible devices with a barbed portion of one in interlocking engagement with a hole in another, or the article can have a barbed portion of one device engaging one of its own holes, or with a combination of such interengagements.

3 Claims, 4 Drawing Sheets

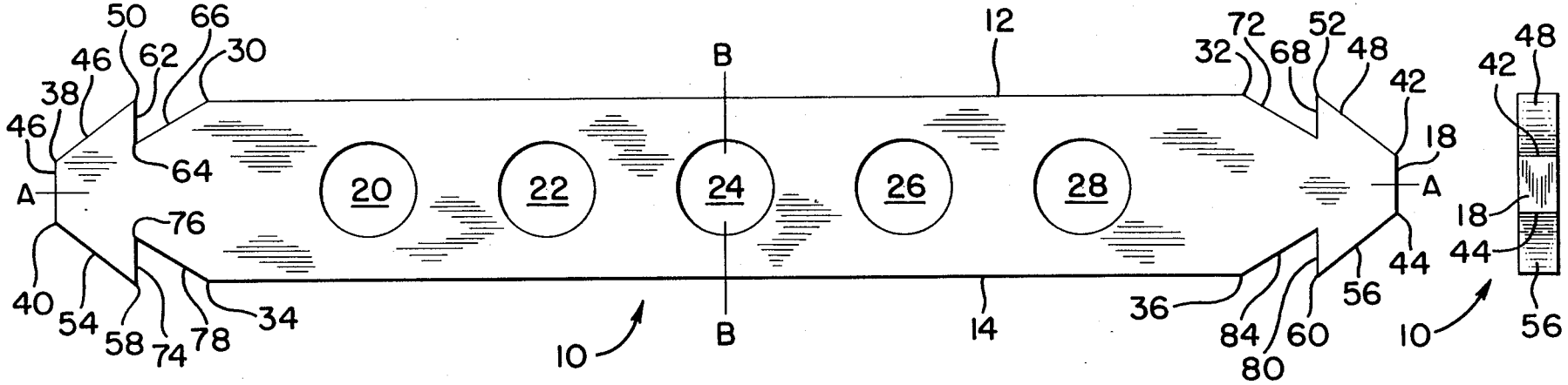
FIG. 3
FIG. 1
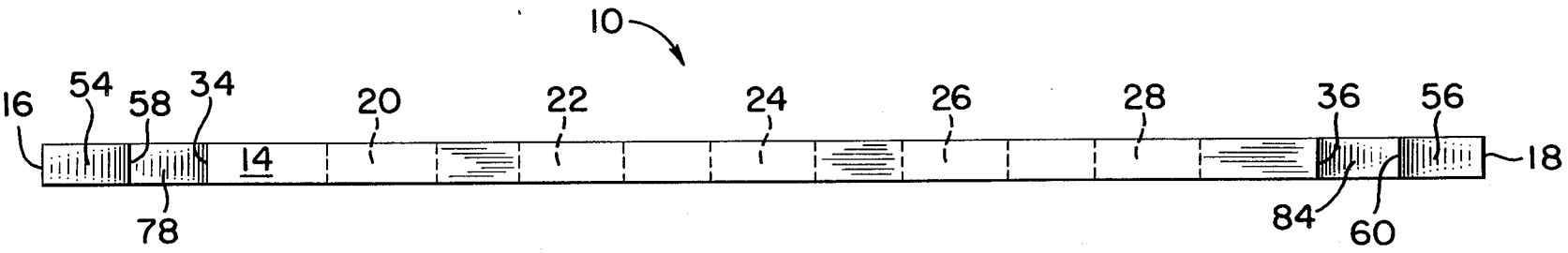
FIG. 2

MULTI-PURPOSE FLEXIBLE DEVICES, METHOD OF MAKING SAME AND ARTICLES MADE THEREFROM

BACKGROUND OF THE INVENTION

This invention relates to multi-purpose flexible devices, to a method of making such multi-purpose flexible devices, and to articles made from such multi-purpose devices. More particularly, the invention relates to such devices which are made from recycled used rubber tire treads.

Some of the myriad uses of the inventive devices are as or in connection with wheel chocks, truck chocks, crash barriers, wheel sidewalls, split tubes, highway bumpers, parking lot abutments, berm covers, lally column covers, thermal insulating covers, threshing machines, anchoring means for sea farming, fish nets, beach erosion control mats, sea wall protective nets, etc.

Nothing sticks to the inventive devices. They do not corrode, and they are easily and economically fabricated. Additionally, the inventive devices are readily color-codable, as by dipping them in polypropylene of different colors. For example, blue may be used for a marker to identify a disabled vehicle and red for fire zones, etc.

Parking lot wheel chocks, for example, may be about 6 feet long and 6 inches wide for cars and 11.5 to 12 feet long and 11.25 inches to 11.5 inches wide for trucks. Truck chocks are 8 inches high by 10 inches wide by 14 inches long.

Typically, on highways, when a crash barrier is hit, the cost of replacement is approximately Five Hundred Sixty Dollars ($560), about fifty percent (50%) each for labor and materials. The invention enables a substantial reduction in cost, which is realized by lowered manufacturing cost, longer useful life, and lowered cost of installation.

Another significant advantage of the invention is that it provides an economic incentive to utilize, instead, of merely to accumulate, used rubber tires. The invention eliminates approximately one million (1,000,000) tons of trash at disposal areas, rivers and street annually.

The method involves the steps of cutting used rubber tires and then stamping to the desired lengths, widths and forms, in a totally evironmentally-accepted atmosphere.

Accordingly, important objects of the invention are to provide an improved flexible device having the advantages set forth above. Another important object of the invention is to provide an economical and simple method of making such devices.

SUMMARY OF THE INVENTION

A flexible device embodying the invention comprises an elongated sheet member of desired form and may be made by the method of separating the tread from the remainder of a used rubber tire and then cutting the tread to the desired form.

The device has a hole of predetermined dimensions therethrough and a barbed portion spaced from the hole and adapted for one-way entry in either direction through a hole into interlocking engagement therewith. Preferably, the device has opposite ends and a barbed portion at each end. The barbed portions are the same and are symmetrical with respect to a longitudinal centerline of the device, and there is a plurality of holes of the predetermined dimensions through the device. The holes are circular and at least some of the holes are centered on the longitudinal centerline. Each barbed portion has a pair of surfaces facing the other barbed portion, and the pairs of surfaces of each barbed portion are spaced from each other at a distance less than the dimension of the holes perpendicular to the longitudinal centerline, i.e., the diameter of the round holes, and the distance between the outermost edges of the pair of surfaces is greater than the diameter of the holes.

An article embodying the invention can be fabricated from a plurality of flexible devices according to the invention with a barbed portion of one such device in interlocking engagement with a hole of another such device, or the article can be fabricated with a barbed portion of one such device an interlocking engagement with one of it own holes, or with a combination of such interengagements.

As is pointed out elsewhere herein, the uses of the inventive devices and articles are myriad.

DESCRIPTION OF THE DRAWING

FIG. 1 is a plan view of a multi-purpose flexible device which is a preferred embodiment of the invention;

FIG. 2 is a side elevation of the device of FIG. 1;

FIG. 3 is an end elevation of the device of FIG. 1;

DESCRIPTION OF THE INVENTION

Figure 4:
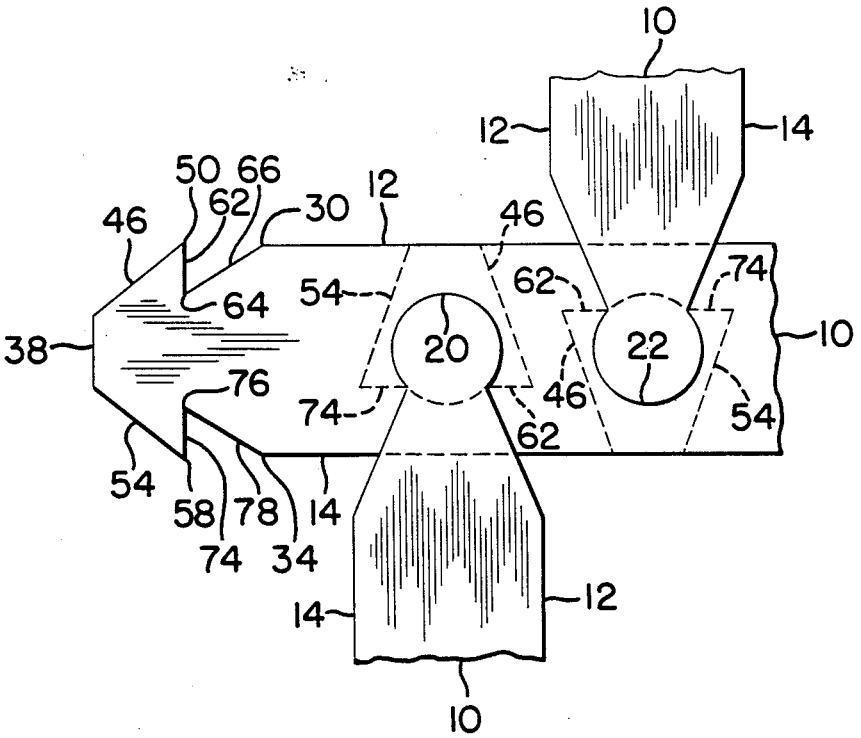
FIG. 4 is a fragmentary plan view showing three (3) FIG. 1 devices, two (2) of which are in interlocking engagement with the third device.

FIGS. 1–3 show a preferred embodiment of the invention, in the form of a multi-purpose flexible device 10 of rubber or rubber-like sheet material of substantially uniform thickness and which can conveniently be manufactured from used tire treads, in a manner described hereinafter. Device 10, which may be thought of as a wire rope, is an elongated member which is symmetrical with respect to a longitudinal centerline A—A (FIG. 1) and also with respect to a transverse centerline B—B (FIG. 1).

Device 10 lies within a rectangular envelope about 6 feet (183 cm) long by 6 inches (15.2 cm) wide, having parallel longitudinal side surfaces 12 and 14 and parallel end surfaces 16 and 18 perpendicular to side surfaces 12 and 14. Side surfaces 12 and 14 are thus spaced about 3 inches (7.6 cm) from line A—A and on opposite sides thereof and end surfaces 16 and 18 are thus spaced about 3 feet (92 cm) from line B—B and on opposite sides thereof. Device 10 has five (5) evenly-spaced circular holes 20, 22, 24, 26 and 28 therethrough, each centered on longitudinal centerline A—A, and each having a diameter of about 4 inches (10.2 cm). Holes 20, 22, 24, 26 and 28 are spaced about 9.5625 inches (24.3 cm) apart, with hole 24 centered on transverse centerline B—B. Holes 20 and 28 are end holes, and hole 22 is midway between holes 20 and 24 and hole 26 in midway between holes 24 an 28.

Side surface 12 is perpendicular to transverse centerline B—B and extends about 28.7 inches (72.9 cm) on each side thereof from an edge 30 adjacent end surface 16 to ah edge 32 adjacent end surface 18. Side surface 14 is perpendicular to transverse centerline B—B and extends about 28.7 inches (72.9 cm) on each side thereof from an edge 34 adjacent end surface 16 to an edge 36 adjacent end surface 18.

End surface 16 is perpendicular to longitudinal centerline A—A and extends about 1 inch (2.54 cm) on each side thereof from an edge 38 to an edge 40. End surface 18 is perpendicular to longitudinal centerline A—A and extends about 1 inch (2.54 cm) on each side thereof from an edge 42 to an edge 44. Edges 38 and 42 are on the same side of line A—A as side surface 12, and edges 40 and 44 are on the same side of line A—A as side surface 14.

Device 10 further has tapered side surfaces 46 and 48. Tapered side surface 46 intersects end surface 16 at edge 38 and tapers outwardly therefrom to an outer edge 50. Outer edge 50 is located in line with side surface 12 and is spaced about 4.3125 inches (11.0 cm) closer to line B—B than end surface 16 and about 3 inches (7.6 cm) from edge 30. Tapered side surface 48 intersects end surface 18 at edge 42 and tapers outwardly, therefrom to an outer edge 52. Outer edge 52 is located in line with side surface 12 and is spaced about 4.3125 inches (11.0 cm) closer to line B—B than end surface 18 and about 3 inches (7.6 cm) from edge 32.

Device 10 additionally has tapered side surfaces 54 and 56. Tapered side surface 54 intersects end surface 16 at edge 40 and tapers outwardly thereform to an outer edge 58. Outer edge 58 is located in line with side surface 14 and is spaced about 4.3125 inches (11.0 cm) closer to line B—B than end surface 16 and about 3 inches (7.6 cm) from edge 34. Tapered side surface 56 intersects end surface 18 at edge 44 and tapers outwardly thereform to an outer edge 60. Outer edge 60 is located in line with side surface 14 and is spaced about 4.3125 inches (11.0 cm) closer to line B—B than end surface 18 and about 3 inches (7.6 cm) from edge 36.

Edge 50 is intersected by a surface 62 parallel to and confronting line B—B and extending toward line A—A to an inner edge 64 which is spaced about 1.5 inches (3.81 cm) from line A—A. Edge 64 is joined to edge 30 by a tapered surface 66. Edge 52 is intersected by a surface 68 parallel to and confronting line B—B and extending toward line A—A to an inner edge which is spaced about 1.5 inches (3.81 cm) from line A—A. The inner edge is joined to edge 32 by a tapered surface 72. Edge 58 is intersected by a surface 74 parallel to and confronting line B—B and extending toward line A—A to an inner edge 76 which is spaced about 1.5 inches (3.81 cm) from line A—A. Edge 76 is joined to edge 34 by a tapered surface 78. Edge 60 is intersected by a surface 80 parallel to and confronting line B—B and extending toward line A—A to an inner edge which is spaced about 1.5 inches (3.81 cm) from line A—A. The inner edge is joined to edge 36 by a tapered surface 84.

Edges 64 and 76 are spaced apart a distance of about 3 inches (7.6 cm), as are edges 70 and 82, while edges 38 and 40 are spaced apart a distance of about 2 inches (5.1 cm) as are edges 42 and 44. The included angle between tapered side surfaces 46 and 54 is about 50°, as is the included angle between tapered side surfaces 48 and 56. The included angle between tapered side surfaces 66 and 78 is about 53°, as is the included angle between tapered side surfaces 72 and 84.

Device 10 may have a nominal thickness of about 0.5 inch (1.27 cm) but this may vary between about 0.25 inch (0.64 cm) and 0.75 inch (1.91 cm), to conform to the range of thicknesses of used rubber tire treads. It is contemplated that device 10 be formed from a used rubber tire by separating the tread from the remainder of the tire and then cutting the tread to the desired shape to form device 10. The cutting step can be performed with the aid of a suitable cutting die (not shown).

It will be noted that device 10 is an elongated flexible sheet member having a hole of predetermined dimensions therethrough, and a barbed portion adapted for one-way entry through a hole of the predetermined dimensions. Once a barbed portion has passed through such a hole in one direction, it cannot be accidentally withdrawn therefrom in the opposite direction, as such withdrawal will be prevented by the overlapping engagement of surfaces 62 and 74 (or surfaces 68 and 80) with the material adjacent the hole.

FIG. 4 illustrates in plan view three (3) multi-purpose flexible devices 10 as shown in FIGS. 1–3 and described above in interlocking engagement, the three (3) devices 10 being shown fragmentarily. More particularly, two (2) of the three (3) devices 10 are shown in interlocking engagement adjacent holes 20 and 22 of the third device 10, but extending in opposite directions therefrom. It is shown that the interlocking engagement of the barbed portion at one end of a device 10 interacts with a hole and material adjacent the hole to prevent accidental withdrawal of the barbed portion from the hole, such accidental withdrawal being prevented by the overlapping engagement of surfaces 62 and 74 (or surfaces edge 68 and 80) with the material adjacent the hole.

It is further to be noted that the interlocking engagement of the barbed portion at either end of one device 10 can be with a hole 20, 22, 24, 26 or 28 of another device 10 or with a hole 20, 22, 24, 26 or 28 of the same device 10.

Figure 5:
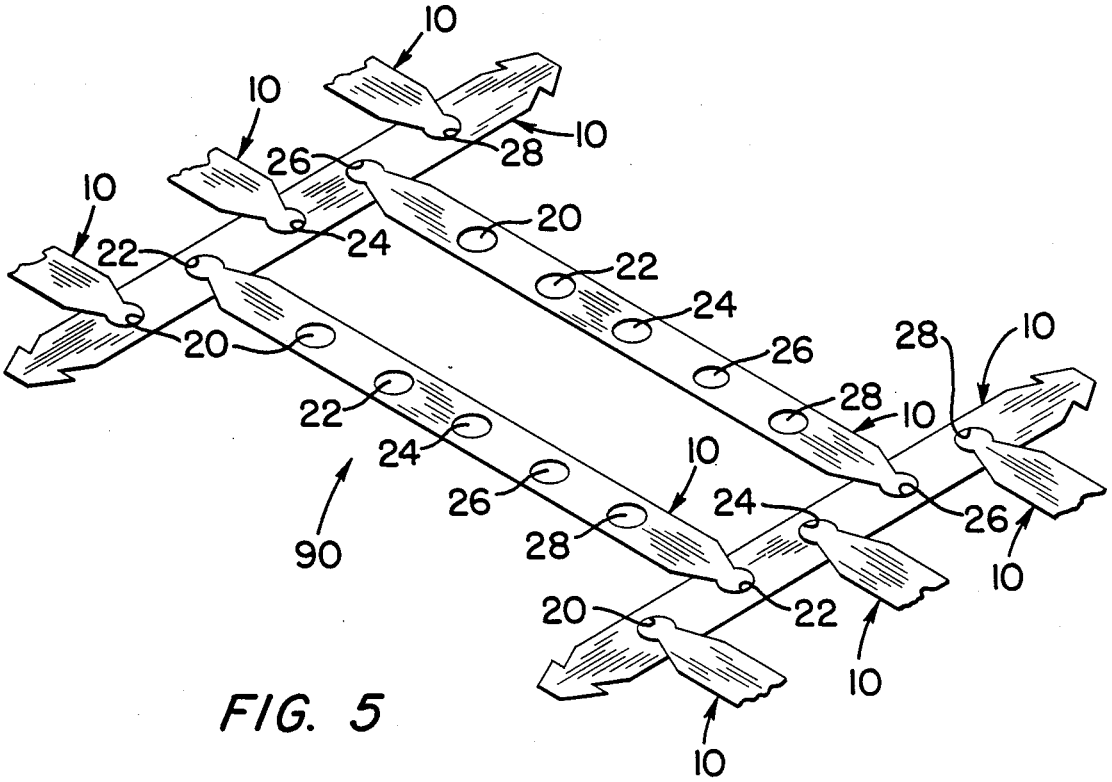
FIG. 5 is a fragmentary perspective view showing a plurality of FIG. 1 devices, each in interlocking engagement with another such device, to form a soil erosion prevention mat embodying the invention.

Many useful articles can be made from devices 10. One such useful article is shown in FIG. 5, which is a fragmentary perspective view of a soil erosion prevention mat 90 embodying the invention. Mat 90, which can be of any desired size, is shown as comprising a first pair of parallel devices 10 with the barbed ends thereof free, the members of the first pair of devices 10 being joined by a second pair of parallel devices 10 with the barbed ends thereof in interlocking engagement with holes 22 and 26 of the first pair of devices 10. Mat 90 further comprises first and second trios of parallel devices 10, shown fragmentarily. Each member of the first and second trios of devices 10 has one of its barbed ends in interlocking engagement with one of holes 20, 24 and 28 of the first pair of parallel devices 10. Mat 90, which can be extended as desired, can be placed on the ground to provide an effective deterrent to erosion.

Figure 6:
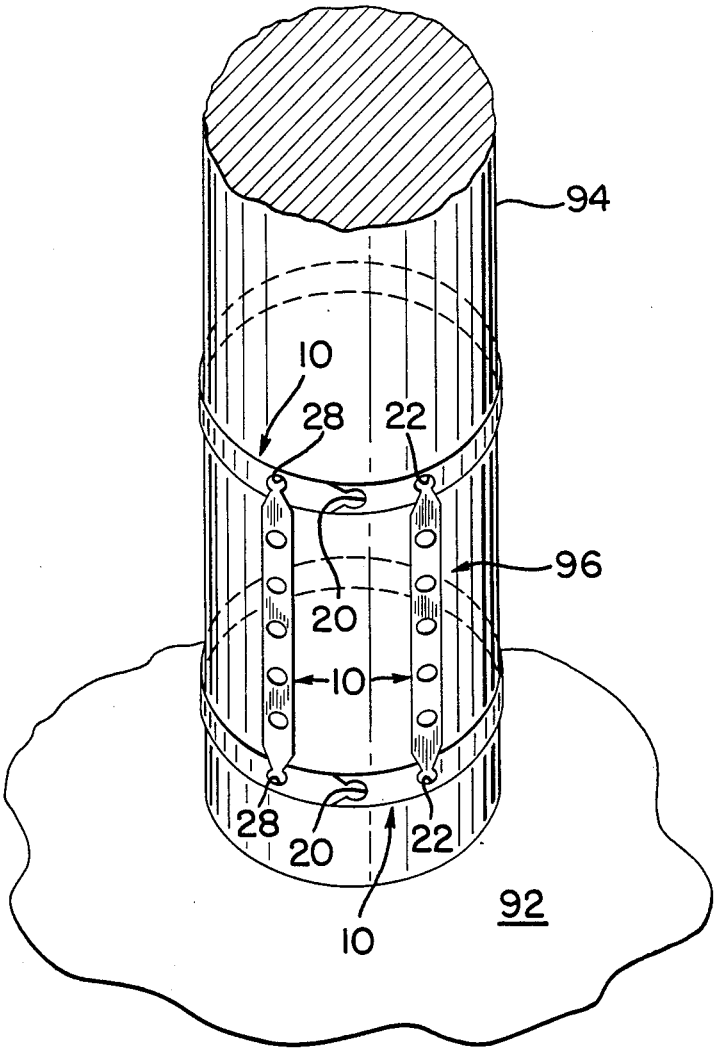
FIG. 6 is a perspective view showing a plurality of FIG. 1 devices, each in interlocking engagement with another 1 such device and some in interlocking engagement with themselves, to form a lally column cover embodying the invention.

FIG. 6 shows a floor 92 with a cylindrical member or lally column 94 rising therefrom, as in a parking garage. Floor 92 and column 94 are shown fragmentarily. It is known that lally columns in parking garages are subject to being hit by vehicles. FIG. 6 also shows a cover such as a lally column cover 96 embodying the invention Lally column cover 96 is made of inventive devices 10. Four (4) devices 10 are shown in cover 96, although more may be included. The four (4) devices 10 include upper and lower devices 10 which are wrapped around lally column in horizontal disposition. One (1) barbed end of each horizontally-disposed device 10 is in interlocking engagement a hole in itself, this being shown as hole 20. It is to be realized that the particular hole will depend on the diameter of column 94.

The four (4) devices 10 of cover 96 also include two (2) devices 10 of vertical disposition, each extending between the upper and lower devices 10. Each of the two (2) devices 10 of vertical disposition has its barbed ends in interlocking engagement with holes in devices 10 of horizontal disposition. As shown, one (1) vertical device 10 has its upper barbed end in interlocking engagement with hole 22 of upper device 10 and its lower barbed end in interlocking engagement with hole 22 of lower device 10, while the vertical device 10 has its upper barbed end in interlocking engagement with hole 28 of upper device 10 and its lower barbed end in interlocking engagement with hole 28 of lower device 10.

Lally column cover 96 effectively reduces accident damage to vehicles striking lally column 94.

Figure 7:
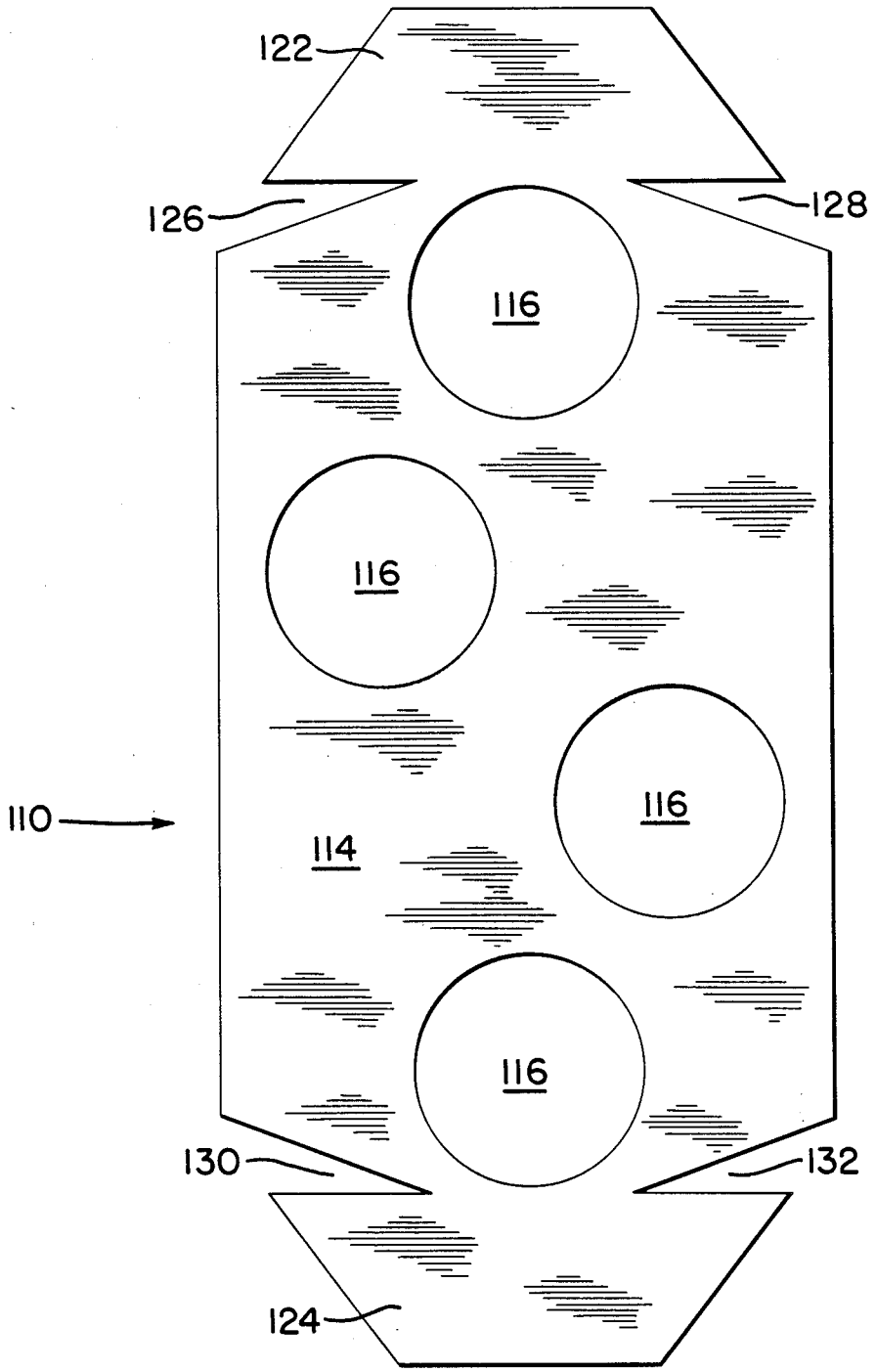
FIG. 7 is a plan view of a multi-purpose flexible device which is a second embodiment of the invention.

FIG. 7 illustrates a modified device 110 embodying the invention. Device 110 is a flexible sheet having a generally rectangular body portion 114 with circular apertures 116 therethrough, arranged in a staggered array along the length of body portion 114. As shown, there are four (4) apertures 116, but this number can be more or less. A barbed end portion 122 is joined to one end of body portion 114. A barbed end portion 124 is joined to the other end of body portion 114. There are triangularly-shaped cutouts as indicated at 126 and 128 between body portion 114 and end portion 122 and triangularly-shaped cutouts 130 and 132 between body portion 114 and end portion 124. End portions 122 and 124 are generally trapezoidal.

Modified device 110 can be formed by the same method as that used to make device 10.

Furthermore, modified device 110 has particular utility as a berm cover, either by itself or with other modified devices 110, either in interlocking engagement with each other in the manner described above for device 10 or not.

To revert to FIG. 6, that view shows a general arrangement of devices 10 which can be used as a thermal covering for a cylindrical member. Thus, cylindrical member 94 can be considered to be a water pipe, in which case cover 96 will help prevent freezing if the water pipe is a cold-water pipe or will tend to reduce water heating costs if the water pipe is a hot-water pipe. The invention can further be used at petroleum tanks to reduce loss of liquids therein through heat dissipation while stored. When so used, the cover can be color-coded to denote the contents of storage tanks at a glance and with a durability many times longer that is afforded with paint.

It is impossible to describe each an every use of the invention in the area of marine application on boat docks, color-coded areas, flotsam control, etc.

It is apparent that the invention in both its article and method aspects well attains the stated objects and advantages and others.

The disclosed details are exemplary only and are not to be taken as limitations on the invention except as those details are included in the appended claims.

I claim:

1. A flexible device comprising an elongated sheet member made from a recycled rubber tire tread, the member being symmetrical with plurality of holes each of predetermined dimensions therethrough and barbed portions at opposite ends thereof adapted for one-way entry through a hole of said predetermined dimensions, at least some of said holes centered on said center line.

2. A flexible device, according to claim 1, wherein said barbed portions are identical, each having a pair of surfaces facing the other said barbed portion, said pair of surfaces of each said barbed portion being spaced from each other a distance less than the dimension of said holes perpendicular to said longitudinal centerline and the distance between the outermost edges of said pair of surfaces being greater than said dimension of said holes perpendicular to said longitudinal centerline.

3. A flexible device, according to claim 2, wherein said holes are circular.

* * * * *